United States Patent [19]

Liberkowski

[11] Patent Number: 4,618,158

[45] Date of Patent: Oct. 21, 1986

[54] ROLLER SKATES FOR FIGURE SKATING

[76] Inventor: Janusz Liberkowski, 5884 Macadam Ct., San Jose, Calif. 95123

[21] Appl. No.: 529,372

[22] Filed: Sep. 6, 1983

[51] Int. Cl.[4] ..... A63C 17/02

[52] U.S. Cl. ..... 280/11.1 BR; 280/11.26

[58] Field of Search ..... 280/11.1 BR, 11.23, 280/11.26, 11.27, 11.28

[56] References Cited

U.S. PATENT DOCUMENTS

| | | | |
|---|---|---|---|
| 108,184 | 10/1870 | Pollitt | 280/11.27 |
| 904,088 | 11/1908 | Rother | 280/11.1 BR |
| 1,703,936 | 3/1929 | Jervoise | 280/11.23 |
| 2,529,314 | 11/1950 | Schmid | 280/11.23 |
| 2,719,724 | 10/1955 | Lungren | 280/11.23 |
| 4,132,425 | 1/1979 | Lehner et al. | 280/11.23 |

*Primary Examiner*—John J. Love
*Assistant Examiner*—Mark C. Dukes
*Attorney, Agent, or Firm*—Cushman, Darby & Cushman

[57] ABSTRACT

Single-row roller skates with widened parameters of movement for figure skating on dry surfaces as on ice, said skate comprising a rigid foot plate mounted on spatial cylindrical body of circular cross section, said body has supports for rotating bearings in horizontal axis of motion and has bung (stop) housings extended on both ends for mounted bearing elements and on them supports for twin-carrier yokes having near the supports of said bearing elements spring elements of regulated brakes remaining in elastic contact with rotating brake surfaces of bungs also having on their opposite ends on shoulders formed spatial yokes, said yokes in horizontal static position form supports for vertical auxiliary eliptical surface rollers, said bi-plane yokes interconnected for mounting front and rear main bearings of skate rollers, said rollers have generating surfaces of coaxial microgrooves, said grooves parallel to plane of roller rotation in direction of travel; said skate has distinctive length between axes of front and rear rollers, said length depends on length of skater's foot and is adjustable by mechanism for change of skate length and blocking by frictional resistance.

12 Claims, 10 Drawing Figures

ROLLER SKATES FOR FIGURE SKATING

The present invention relates to roller skates for performing the sport of figure skating on dry surfaces. More particularly, this invention pertains to the construction of special roller skates with a widened parameters of movement primarily for the purpose of figure skating.

Known today and used in the sport of roller skating are skates for movement on smooth, hard and dry surfaces. Prior roller skates may be classified, according to the number of pairs of rotating elements, into single and multi-row types. The prior single-row skate consists of a flat and rigid metallic foot plate. A suspended body is fastened to the skate plate for mounting of bearings in the horizontal axis of rotation. Two or more and usually not less than four rotating elements are employed. The bearings have a flat race of a designated width. In some designs, the race is slightly profiled by the radius of rotation in an arc traverse to the direction of a skater's movement.

Also known, and commonly used for figure skating, are skates constructed on cylindrical rotating elements. Such cylindrical rotating elements are designed for the purpose of maintaining the desired direction of a skater's travel. Previously available roller skates have several deficiencies. The basic deficiency, in roller skates used in figure skating, is a resistance to the performance of certain movements needed for the execution of complicated figures.

The use of cylindrical rollers, as rotating elements in a skate, requires a definite and considerable width in the housing construction. Because of such increased housing width, and for other technical reasons, it is exceedingly difficult and dangerous for a skater using prior art roller skates to perform tight turns, pirouettes or typical figures and jumps, such as "lue", "schelchoff" and other techniques. Previously available skate designs do not enhance the turning ability of a roller skate. In summary, known roller skates do not permit the skater to accomplish the same objectives, within technical possibilities, which may be achieved with typical skates used on ice.

SUMMARY OF THE INVENTION

The present invention is directed to an improved construction of a roller skate with expanded parameters of movement as especially needed in figure skating. A roller skate in accordance with the invention permits figure skating on dry, smooth and hard surfaces with functional abilities which are substantially the same as needed in ice skating.

In the sectional plane, perpendicular to the main horizontal axis of the skate base, the basic rotating element of a skate in accordance with the invention has a circular or near circular cross section. The skate includes a plate, having a flat upper surface, which is rigidly fastened to a skate body of considerable structural rigidity and strength, especially along the horizontal axis. The skate body defines housings for the mounting of rotating bearing elements on both ends thereof. Retainers for first ends of twin-carrier type yokes are supported from these bearing elements and are coupled thereto by spring loaded brakes. The brakes include braking elements which are resiliently biased into contact with brake surfaces with the degree of loading being defined by the amount of rotation of the carrier yokes. The carrier yokes have, on their opposite ends on horizontal shoulders, carriers for supporting further bearing housings that hold auxiliary bearings which are rotatable about vertical axes. Auxiliary eliptical (barrel) type rotating rollers extend between and thus interconnect normally vertically spaced pairs of arms of the yokes and are rotatable in the auxiliary bearings. The carrier yokes form the axis of bearing housing for spherical main rollers which contact the surface over which the skate travels. The radius of the spherical rollers is the same as the radius of the curvature of the barrel-type surface of the auxiliary rollers. The rotating surface of the brakes, which cooperate with the bearing elements have, when viewed in horizontal section in a vertical plane, a form which is not round and its largest radius is located in the vertical axis or near it. The diameter of the spherical rollers is greater than the diameter of the carrier-yoke supports; also the diameter of the forwardly disposed auxiliary rollers need not be equal to the diameter of the auxiliary rear rollers. For a most practical construction, the diameter of the spherical rollers will be the same.

The distance between the axes of rotation of the front and rear spherical rollers depends on the length of the skater's foot. This length may be adjusted by a mechanism which allows smooth change of length and locks by frictional resistance. The magnitude of the functional length, i.e., the distance between the axes of rotation of the main spherical rollers, is in the range 0.3 to 2.2 lengths of a skater's foot. Along the traverse axis or axis of side slide, the roller skate has a smaller moment of velocity than the moment of velocity in the axis of travel.

The movement generating surface of the spherical roller preferably has several circumferential and concentric microgrooves. The planes defined by these grooves are parallel to the plane of roller rotation in the direction of the velocity moment along the axis of travel.

The roller skates of the present invention enable figure skating similar to that performed on ice. The improved skate thus offers several beneficial advantages in sporting equipment of a new type. It combines lightness and turning ability as in ice figure skating. The new roller skate also possesses the mechanical resistance and strength required for extended dynamic loading of typical single-row roller skates. The improved skate additionally allows for continuous training of competitors for ice skating. The skates may be used independent of the time of the year and conditions of the training terrain.

The improved roller skate of the present invention utilizes the principle of surface point contact instead of linear contact (as in ice skating) or continuous contact with a surface (as in roller skates of the traditional construction). The roller skate is for figure skating on smooth as well as rough surfaces. The ability of the roller skate to control and to brake side sliding motion indicates new qualities in motion approaching the kinetic character of phenomena experienced in traveling on a wind-surfing board.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE DISCLOSED EMBODIMENT

The basic structural characteristic of the roller skate is that the base wheel rotating elements (spherical rollers 15) have a circular cross section in the plane perpendicular to the main horizontal axis X—X.

Figure 1:
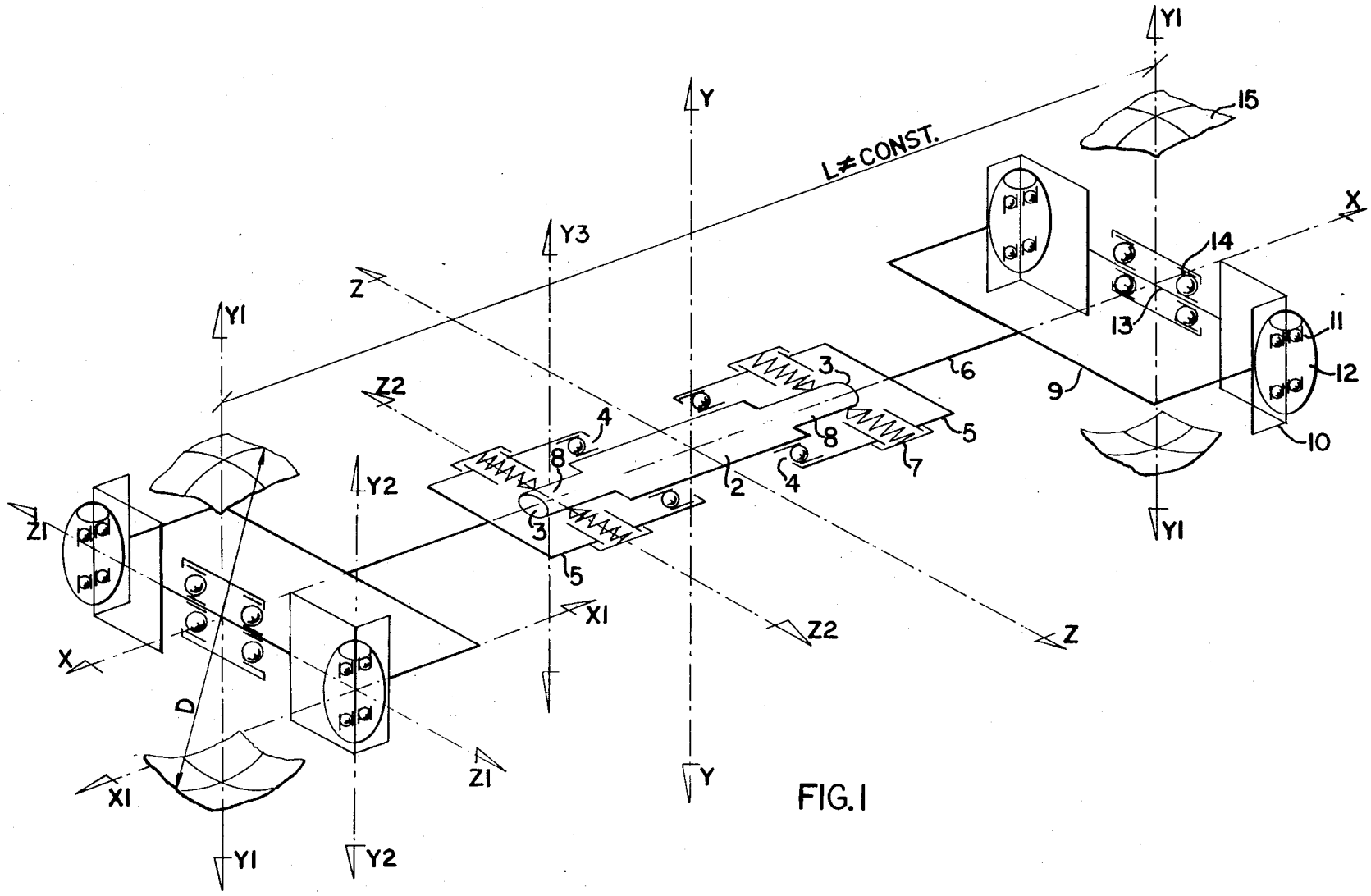
FIG. 1 is a schematic, i.e., "kinematic", perspective view of a roller skate in accordance with a first embodiment of the present invention.
Figure 4:
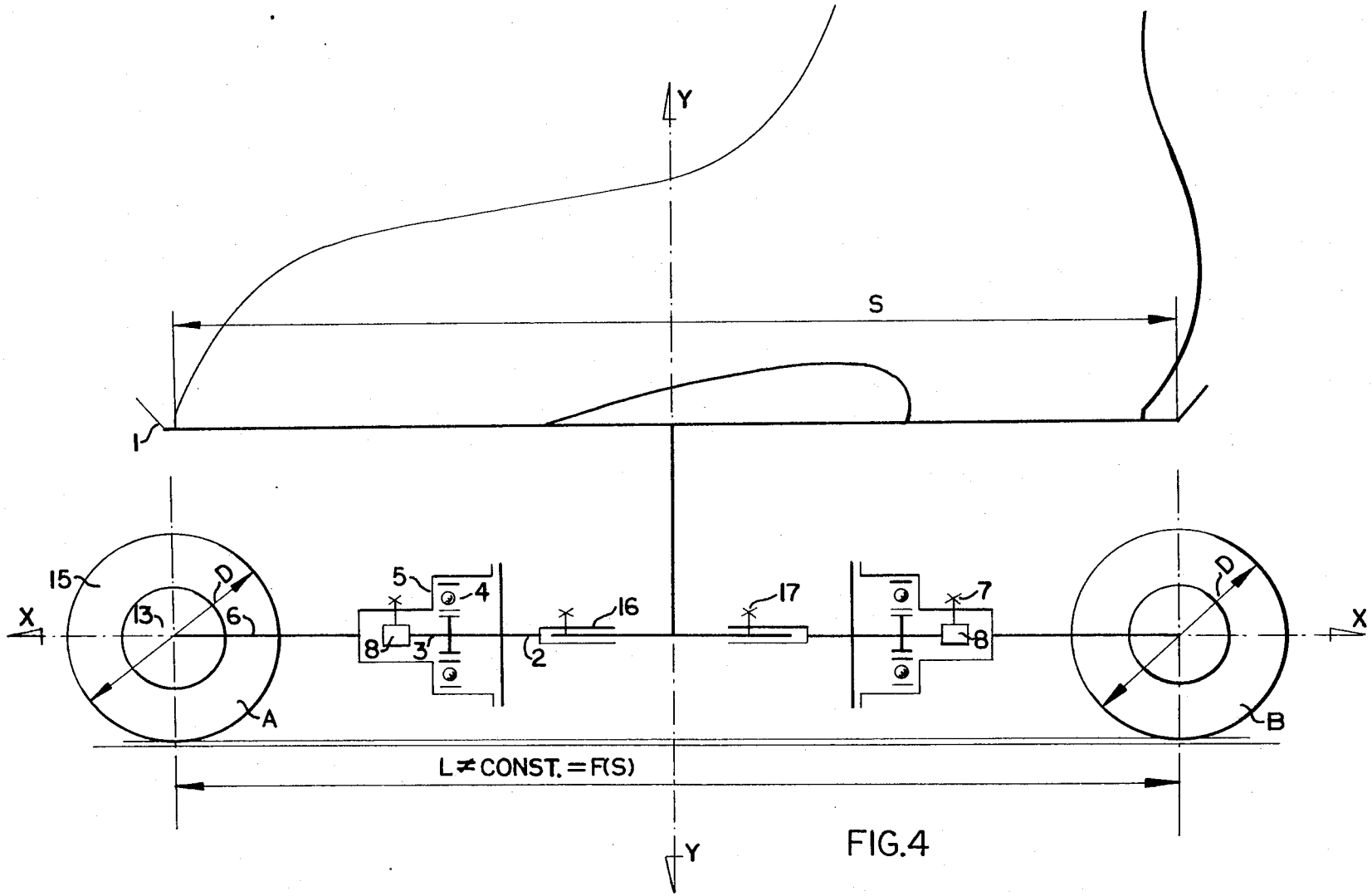
FIG. 4 is a schematic, cross-sectional side elevation view of the skate of FIG. 1.
Figure 9:
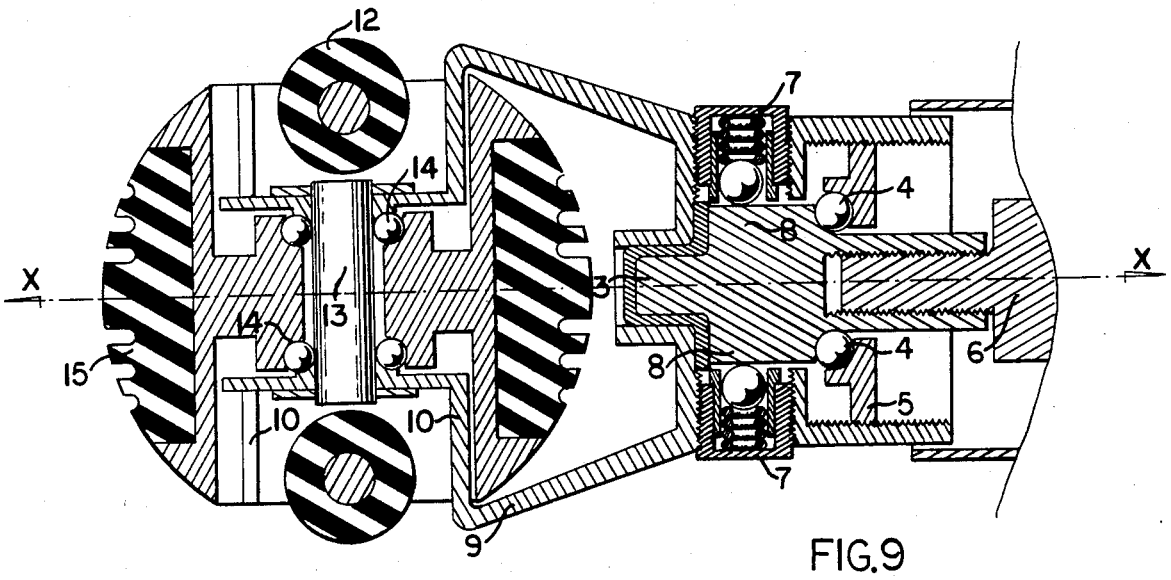
FIG. 9 is a cross-sectional view taken along line 9—9 of FIG. 5.
Figure 10:
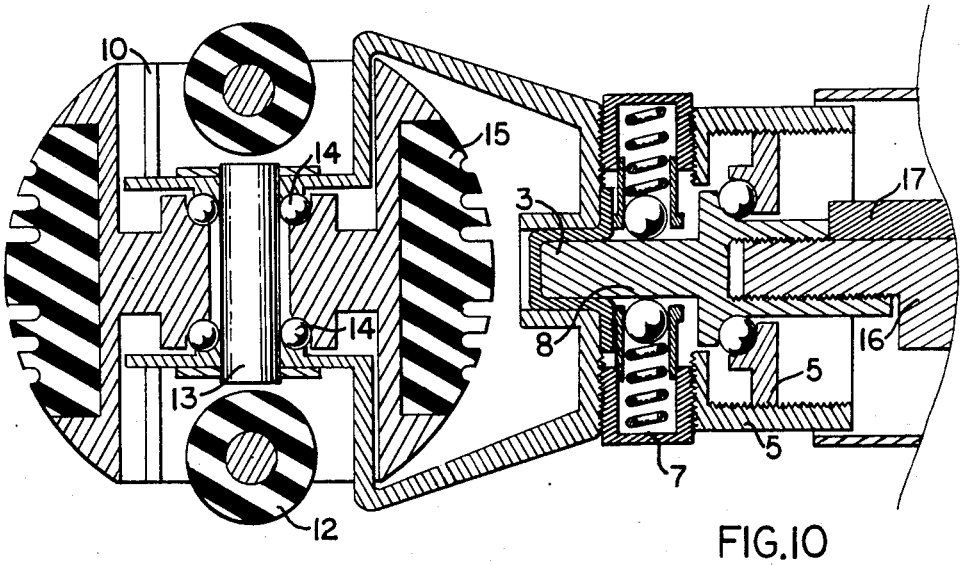
FIG. 10 is a cross-sectional view, similar to the roller of FIG. 9, but with the roller rotated 90° to illustrate action of the breaking mechanism.

The basic design of a roller skate, as presented in this improvement, and shown in FIG. 10 consists of a rigid foot plate (1) having a flat upper surface which is fastened in a plane defined by vertical axes Y—Y to a cylindrical housing (2). Housing 2 preferably has a circular cross section. The housing has considerable rigidity, especially along its horizontal axes X—X. The housing (2) has an axis which defines the horizontal axis of the skate. Bearing stops 3 define axial extensions of housing 2. The bearing stops 3 are rotatable and include integral brake surface defining portions 8. The bearing stops 3 are mounted from housing 2 by means of bearings 4 and the support structure therefor which is indicated generally at 5, this support bearing structure being shown schematically in FIG. 1 and in mechanical detail in FIGS. 9 and 10. Carrier yoke supports 6 are affixed to bearing stops 3. The means for coupling the housing 2 to the carrier yoke supports 6 includes a braking mechanism comprising the portions 8 of the bearing stop 3 and bearings which are loaded thereagainst by means of springs 7 as shown in FIGS. 1 and 4 and in mechanical detail in FIGS. 9 and 10. The degree of compression of the spring 7 is a function of the angular position of the bearing stop 3. Thus, the braking mechanism comprises radially mounted spring-controlled brakes which automatically adjust a retarding force to rotation of the yoke supports 6 as a function of the degree of rotation thereof by means of regulating the compression of and thus the force exerted by springs 7 against the bearings which contact the brake surface defined by portion 8 of bearing stop 3. The bearings of the brake mechanism will at all times be in elastic contact with the rotatable brake surfaces 8.

Figure 2:
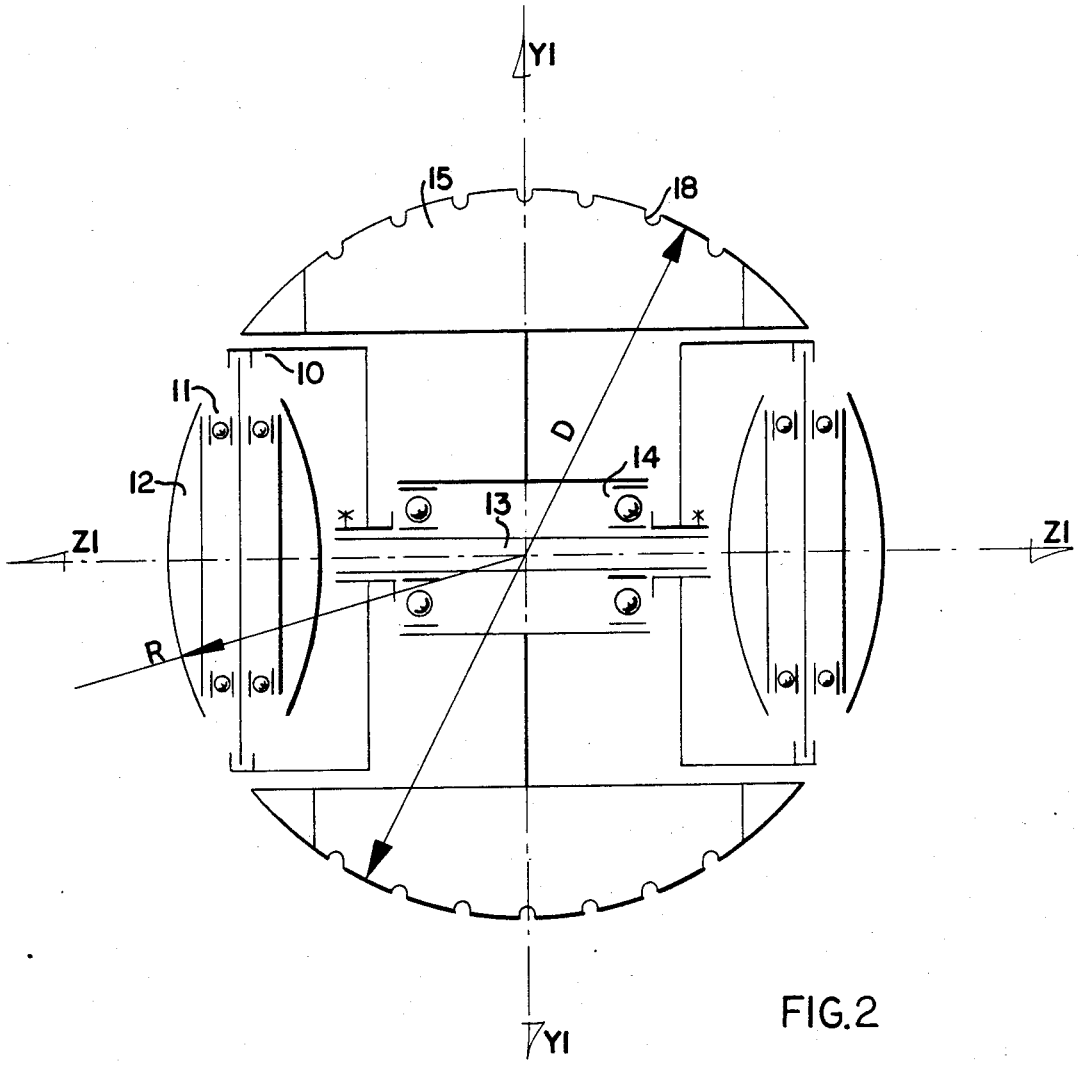
FIG. 2 is a schematic, cross-sectional front elevation view taken along the Y-Z plane as the skate is depicted in FIG. 1.
Figure 3:
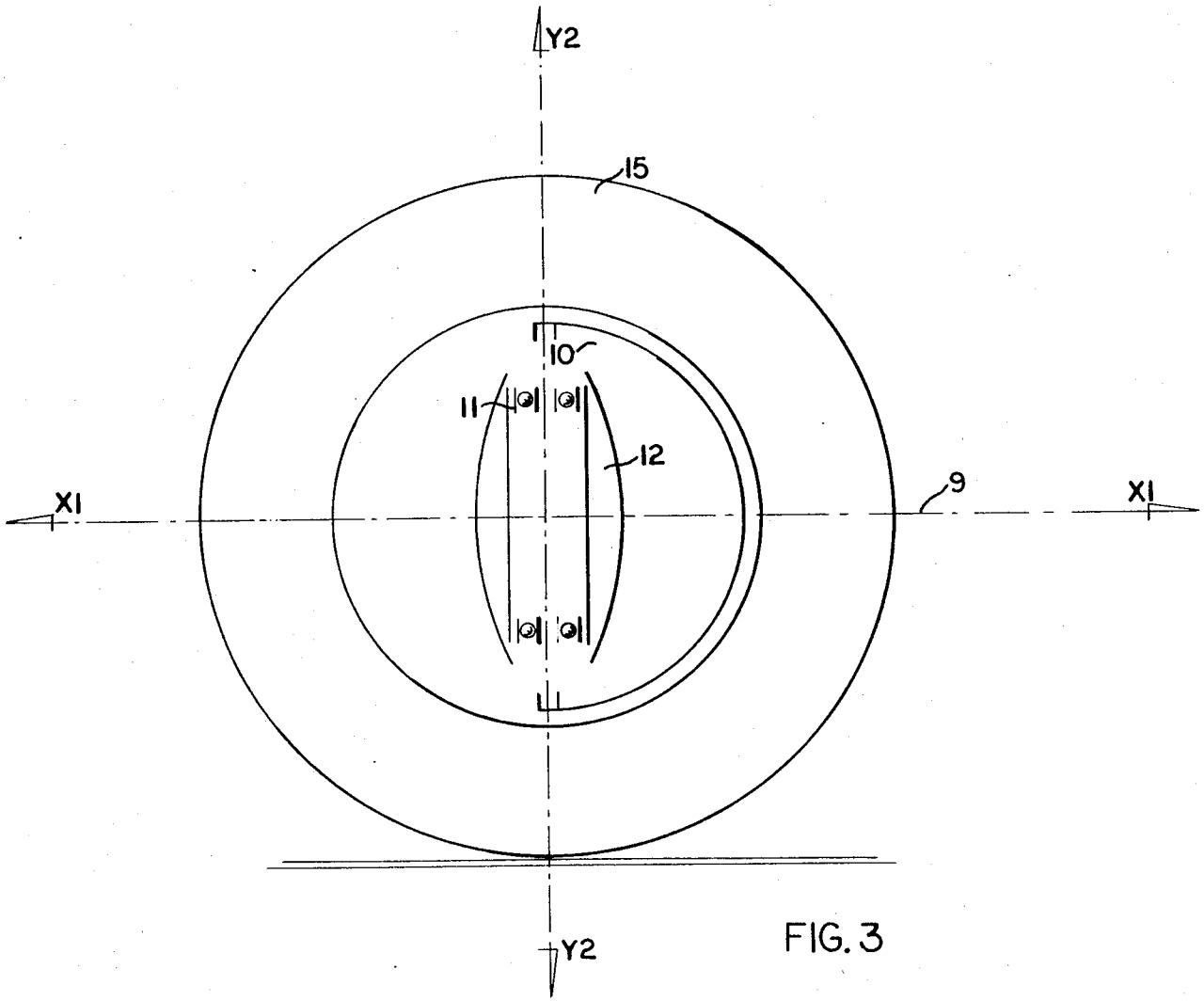
FIG. 3 is a view similar to FIG. 2 but rotated by 90°.
Figure 5:
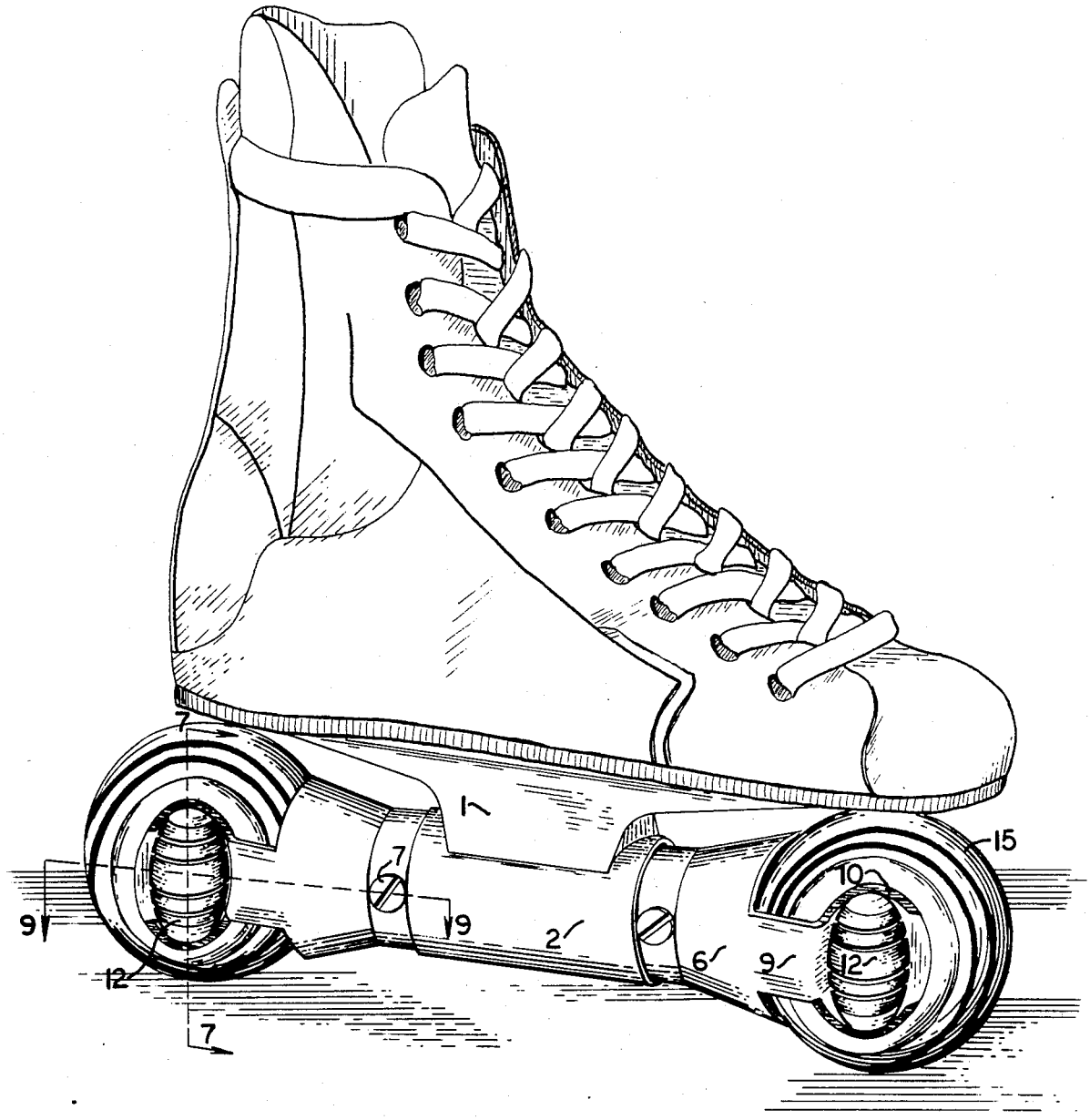
FIG. 5 is a perspective view of the skate which is illustrated schematically in FIG. 1.
Figure 6:
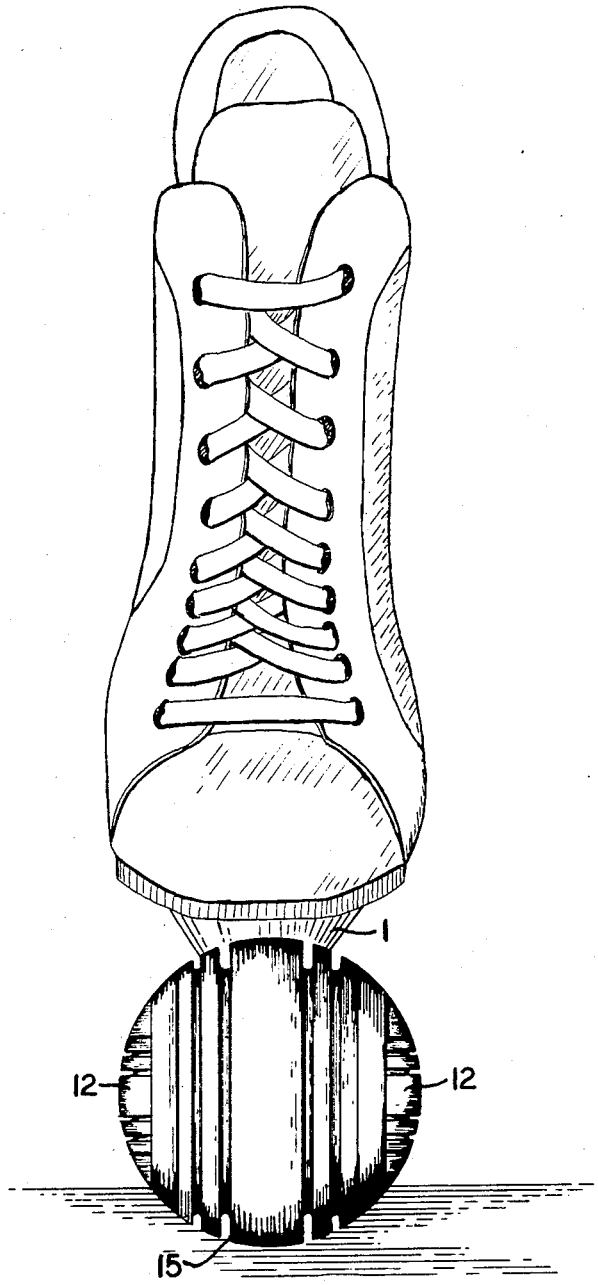
FIG. 6 is a front view of the skate of FIG. 5.
Figure 8:
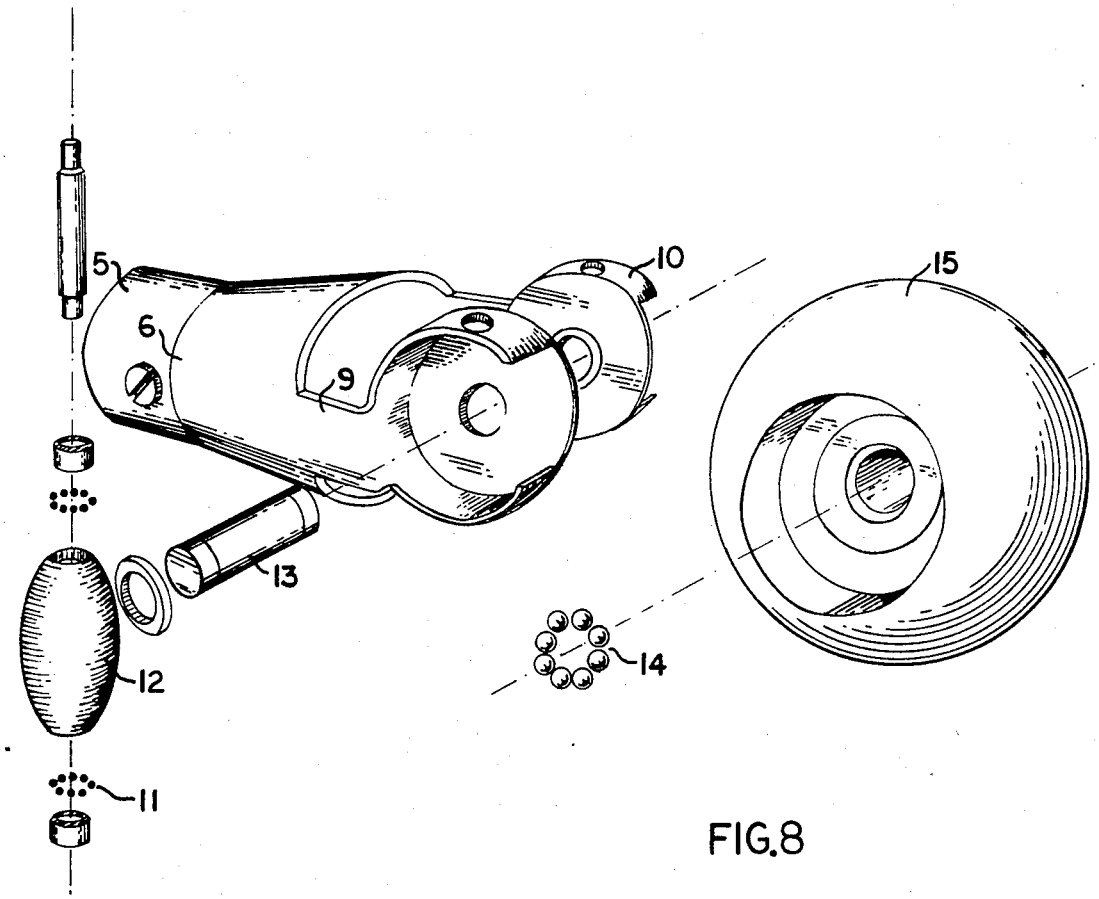
FIG. 8 is an exploded view of roller support assembly of the roller of FIG. 1.

Spatial carrier yokes (10), as particularly shown in FIGS. 8–10, are provided on the opposite ends of the yoke supports (6) on their arms (9), the arms 9 being horizontally oriented with the skate at rest as may be seen from the schematic representation of FIG. 2 and the perspective view of FIG. 5. The yokes form a spatial two-plane frame for mounting single-row ball bearings (11). The bearings 11 rotate about vertical axes Y2—Y2 as may be seen from FIG. 1. The bearings 11 support the auxiliary rollers (12) which have an eliptical (barrel) configuration. In the horizontal axis Z1—Z1, transverse extensions (13) of the yokes (10) define the axles of rollers 15 and function as the inner races for bearings (14) of ball-type, single-row. The main rollers 15 of the skate are supported on bearings 14. In the preferred embodiment, the radius R (FIG. 2) is 0.5 D, i.e., the outside diameter of the spherical roller (15). Restated, it is preferred that the outer surface of the auxiliary rollers 12 define an extension of the surface of spherical roller (15).

The rotating brake surface (8) of bearing stop (3) has, in cross-section when viewed in vertical plane Y3-Z2, a configuration which is not round. The largest radius of the configuration is normally, i.e., when the skater is not performing a turning maneuver, located in the vertical axis Y3 or near it.

The diameter D of the spherical roller (15) is greater than the diameter of bearing supports (5) of the carrier yoke supports (6). Diameter D of the front spherical roller (**15*a*) is typically not equal to the diameter of rear roller (15*b*). Another advantageous design is for both rollers (15**) to be of the same size.

The characteristic length (L) of the roller skate is the distance between a pair of vertical axes Y1—Y1 through rollers (15) is a function f(s) where s is the length of a skater's foot. The length is set advantageously according to the requirements of the skater by means of a mechanism (16), which is telescopic for smooth change of length, and having a frictional stop (17). The magnitude of function f (s) is maintained within the limits of 0.3–2.2 s.

Along the axis Z—Z of the side slide, the roller skate has a velocity moment smaller than the moment of velocity along the X—X axis of travel. This results from the automatic change in the tension of the regulated braking element produced through the compression of springs (7) when a side slide occurs.

Figure 7:
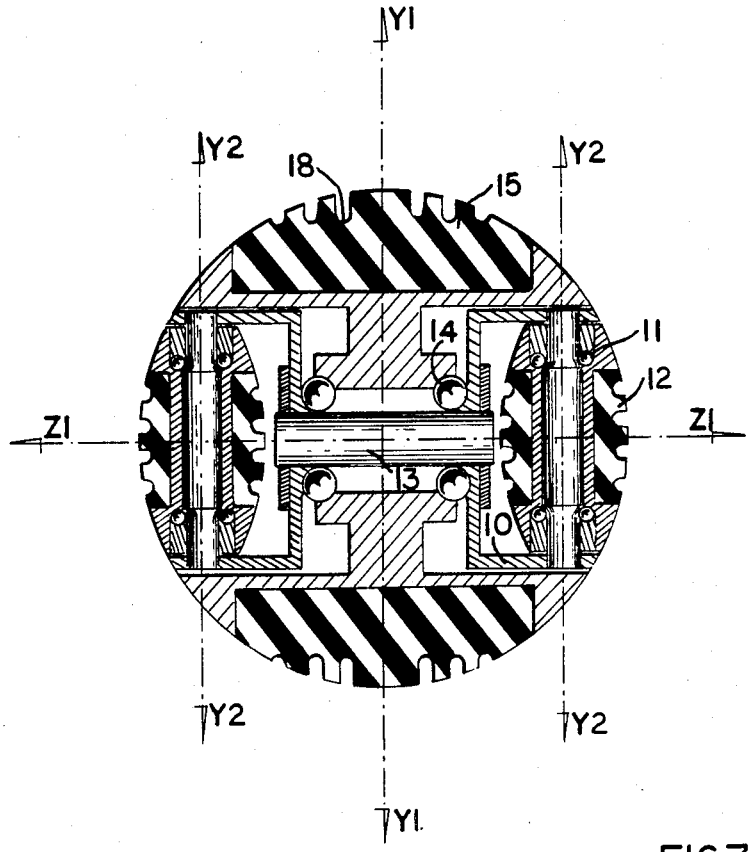
FIG. 7 is a cross-sectional view taken along line 7—7 of FIG. 5.

The outer surface of the roller (15) has several coaxial micro-grooves (18) which are shown in exaggerated size in FIG. 7. The planes defined by grooves (18) are parallel to plane X-Y1 of roller (15).

It is to be understood that the present invention is not limited to the embodiment described and shown herein, which is deemed to be merely illustrative of the best mode of carrying out the invention, and which is susceptible of modification of form, size, arrangement of parts and details of operation. The invention rather is intended to encompass all such modifications which are within its spirit and scope as defined by the claims.

What is claimed is:

1. An improved roller skate comprising:

rigid foot plate means, said foot plate means being elongated and defining an axis;

housing means affixed to a first side of said foot plate means;

first and second carrier yoke means, said carrier yoke means each having two pair of outwardly extending generally parallel arms;

means supporting said carrier yoke from opposite ends of said housing means, said supporting means positioning said carrier yoke means so that the arms thereof extend in opposite directions and generally parallel to said foot plate means axis;

two pairs of first rollers, said rollers each having an axis of rotation and an outer surface which is convex with respect the axis of rotation;

first bearing means for rotatably supporting respective of said first rollers between the spaced arms of said pairs of arms of said carrier yoke means whereby a pair of said first rollers are supported with their axes of rotation substantially parallel from each of said carrier yoke means a pair of second rollers, said second rollers each having an axis and an outer surface which is convex with respect to the axis of rotation thereof; and second bearing means on each of said carrier yokes for rotatably supporting a respective one of said second rollers thereon, with the axes of rotation thereof lying substantially in respective of a pair of substantially parallel planes defined by the axes of rotation of said first rollers of each pair, said planes being substantially transverse to the axis of said foot plate means, the convex surfaces of said first rollers of each pair cooperating with the convex surface of one of said second rollers to define a skate wheel having a generally circular configuration when viewed in said planes.

2. The skate of claim 1 wherein said foot plate means is telescopic.

3. The skate of claim 2 wherein the outer surface of said second rollers are grooved.

4. The skate of 3 wherein said housing means has a circular cross-section.

5. The skate of claim 4 wherein said skate wheels are generally ball-shaped.

6. The skate of 1 wherein said housing means has a circular cross-section.

7. The skate of claim 6 wherein said foot plate means is telescopic.

8. The skate of claim 1 wherein said skate wheels are generally ball-shaped.

9. The apparatus of claim 1 wherein the axes of rotation of said first rollers of each of said pairs of first rollers is transverse to the axis of rotation of one of said second rollers.

10. The apparatus of claim 1 wherein the convex outer surfaces of said second rollers are grooved.

11. The apparatus of claim 1 further comprising:

brake means, said brake means being positioned within said housing means and coupling said carrier yoke means to said foot plate means.

12. The apparatus of claim 1 wherein said first rollers are each generally barrel-shaped and the convex surface thereof has a radius which is substantially equal to the radius of the convex surfaces of said second rollers.

* * * * *